United States Patent [19]

Jennings, Jr. et al.

[11] Patent Number: 4,703,799

[45] **Date of Patent: * Nov. 3, 1987**

[54] TECHNIQUE FOR IMPROVING GRAVEL PACK OPERATIONS IN DEVIATED WELLBORES

[75] Inventors: Alfred R. Jennings, Jr., Plano; Malcolm K. Strubhar, Irving, both of Tex.

[73] Assignee: Mobil Oil Corporation, New York, N.Y.

[ * ] Notice: The portion of the term of this patent subsequent to May 12, 2004 has been disclaimed.

[21] Appl. No.: 815,968

[22] Filed: Jan. 3, 1986

[51] Int. Cl.[4] ..... E21B 43/04

[52] U.S. Cl. ..... 166/276; 166/50; 166/278; 166/294

[58] Field of Search ..... 166/278, 276, 50, 297, 166/294, 281, 290

[56] References Cited

U.S. PATENT DOCUMENTS

| | | | |
|---|---|---|---|
| 3,695,355 | 10/1972 | Wood et al. | 166/295 |
| 3,800,847 | 4/1974 | Rike | 166/295 |
| 3,983,941 | 10/1976 | Fitch | 166/276 |
| 4,016,931 | 4/1977 | Cryar, Jr. | 166/276 |
| 4,194,577 | 3/1980 | Vann | 175/4.51 |
| 4,265,311 | 5/1981 | Ely | 166/271 |
| 4,333,461 | 6/1982 | Muller | 128/284 |
| 4,378,049 | 3/1983 | Hsu et al. | 166/295 |
| 4,428,427 | 1/1984 | Friedman | 166/278 |
| 4,549,608 | 10/1985 | Stowe et al. | 166/280 |
| 4,552,215 | 11/1985 | Almond et al. | 166/278 |
| 4,553,595 | 11/1985 | Huang et al. | 166/278 |

*Primary Examiner*—James A. Leppink
*Assistant Examiner*—Hoang C. Dang
*Attorney, Agent, or Firm*—Alexander J. McKillop; Michael G. Gilman; Charles A. Malone

[57] ABSTRACT

A method for completion of an inclined or deviated well having an in-line opening on its lower side. A work string tubing is removed and a production tube having a slotted liner is directed through a gelled fluid. The gelled fluid is removed and an in-casing gravel pack is placed within said wellbore. Hydrocarbonaceous fluids are then produced from said wellbore.

30 Claims, 1 Drawing Figure

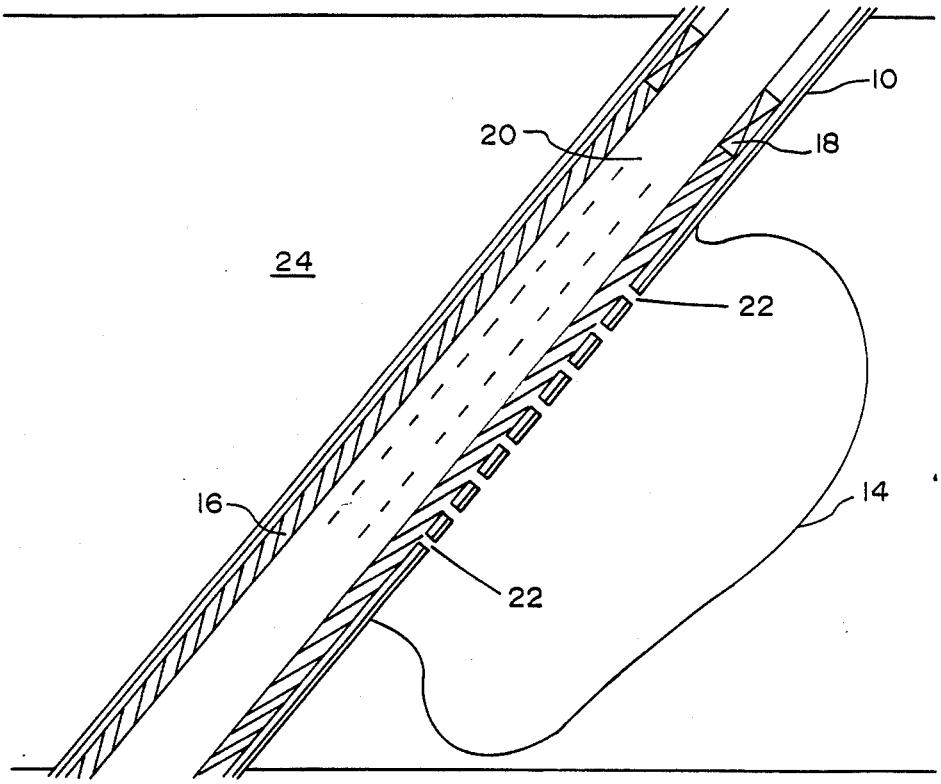
10
20
18
24
22
16
14
22

TECHNIQUE FOR IMPROVING GRAVEL PACK OPERATIONS IN DEVIATED WELLBORES

FIELD OF THE INVENTION

This invention is directed to a method for well completion where a gravel pack is utilized in a deviated or inclined wellbore having in-line openings on the low side of said wellbore.

BACKGROUND OF THE INVENTION

The success of in-casing gravel packs using a slotted liner in a perforated casing is highly dependent on established gravel/formation fine size relationships. With study and experience, it is possible to select the proper gravel size to optimize produtivity while controlling formation fines invasion into the wellbore. Success of the gravel pack is very dependent on effective placement of the gravel. Ordinarily, this can be successfully accomplished in a vertical wellbore.

Most loosely consolidated formations where fines production is likely to occur are located offshore where many wells are drilled from a single platform. Most wells are drilled on an incline, resulting in completions through the pay intervals at an angle. In these wells, it is more difficult to place a gravel pack effectively due to the inclination of the hole. Because of the inclination of inclined or deviated wellbores, conventional gravel packing procedures meet with limited success in these wells.

Gravel packing is a secondary sand placement technique involving the introduction of a fluid suspension of exogenous particulate matter downhole, to fill the wash-out cavities or to "squeeze" to pack into the formation in the vicinity of the well. The term gravel is somewhat loosely applied in the art to encompass hard, rigid particulate matter ranging in size from a coarse sand to pebble size material.

Once the placement of sand and gravel has been accomplished, a slotted liner or "screen" placed as part of the production string helps hold the loose filling material and retard the upstream sand flow through the filler material during production conditions.

Present gravel pack procedures often require a filling of the casing with weighted completion fluid or drilling mud prior to perforating. Thereafter, the production casing is perforated via a casing gun with shots placed in a helical arrangement. Substantial amounts of wellbore fluid are often lost, as in most instances, the wellbore is in an overbalanced condition. If the well is not completely dead following the perforation operation, it is generally "killed" so the perforating tool can be pulled from the borehole. After pulling the perforating tool from the borehole, the production tubing along with a slotted liner is directed into the borehole. As a result of these operations, substantial amounts of expensive workover fluid can be lost during these operations. Because of the density, viscosity and chemical makeup of these workover fluids, damage often occurs to the permeability of a formation. Afterwards, in order to stabilize the sand in the formation, an in-casing gravel pack is generally placed within the wellbore along with additional fluids and chemicals. This results often in additional damage to the permeability of the formation.

Therefore, what is needed is a method for a gravel pack operation in inclined or deviated wells which will minimize permeability damage to the formation caused by workover fluids and chemicals.

SUMMARY OF THE INVENTION

This invention is directed to a method for completion of a well having a deviated or inclined wellbore. In the practice of this invention, a production liner (casing) is cemented in the wellbore. A work string tubing is then run through said production liner to a depth above an interval to be perforated. Afterwards, the production liner is perforated with thru-tubing devices to achieve communication between a hydrocarbonaceous pay zone and the wellbore. Perforations are placed in-line on the low side of the production liner with an in-line perforating means, thereby creating a perforated zone. Subsequently, a sufficient quantity of a solidifiable material is pumped into the wellbore so that not only is a specified quantity injected into the formation but also a volume remains in the wellbore filling it to a level substantially above the perforated zone.

Due to the thixotropic properties of the solidifiable material, substantial strength and viscosity are developed such that a "plug" is formed. This "plug" becomes very difficult to move, behaving substantially like a solid or mechanical plug. This behavior prevents formation fluids from entering said wellbore through said perforations. A weighted solution is placed on top of said plug in a manner that results in a hydrostatic pressure in the wellbore that is greater than the natural occurring formation pressure. The "overbalance" of pressure into the reservoir does not result in wellbore fluids invading the reservoir, however, due to the presence and blocking action of the plug. This mechanism then allows change-out of said work string tubing with a production tubing and slotted liner to be done safely. Next, a production tubing having a slotted liner (or wire-wrapped screen) is directed through said weighted solution and said plug.

The plug is removed and gravel packing is commenced within the in-casing area substantially near the perforated zone. Said gravel packing is sufficient to exclude formation particulate matter from the well when producing hydrocarbonaceous fluids therefrom.

It is therefore an object of this invention to minimize formation damage using a temporary gel plug to isolate a formation wherein a gravel pack is utilized in conjunction with an inclined wellbore.

It is a still further object of this invention to protect the integrity of a formation which is sensitive to fluid intrusion from chemicals and workover fluids which formation is penetrated by an inclined well.

It is a still yet further object of this invention to increase the production of hydrocarbonaceous fluids from a hydrocarbonaceous fluid producing formation.

BRIEF DESCRIPTION OF THE DRAWING

The drawing is a schematic view of an inclined wellbore showing a slotted liner in combination with an in-casing gravel pack.

DESCRIPTION OF THE PREFERRED EMBODIMENTS

In the practice of this invention, an inclined wellbore penetrates a hydrocarbonaceous pay zone in formation 24, as shown in the drawing. A casing 10 is placed in the wellbore and cemented. Subsequently, a work string tubing (not shown) is run through and inside of casing 10. The work string tubing proceeds within said casing 10 near the top of the pay zone of the formation 24. At the pay zone, the casing 10 is opened with a means for creating openings "in-line" in said casing 10 on its low side thereby creating an opened zone through the wellbore which communicates with the pay zone of formation 24. One method of making the "in-line" openings is via performations through said wellbore and into formation 24.

This method will be particularly benefical when used in conjunction with an in-line opening on the low side of an inclined or deviated wellbore. Said in-line opening may comprise at least one notch or perforation. As is preferred, multiple perforations can be utilized. The density of these perforations should be at least four perforations per foot, Said perforations can be made in the casing of said inclined wellbore with a "through tubing" perforating gun equipped with a magnetized decentralizer. A perforating gun which can be used is the 2⅛ inch Schlumberger Enerjet. This gun should be loaded with respect to said decentralizer to shoot in-line (0° phasing) perforations on the low side of the casing. A magnetic decentralizer which can be used for this purpose is sold by Dowell-Schlumberger located in various field service locations. Other methods of perforating the casing are discussed in U.S. Pat. No. 3,983,941 issued to Fitch on Oct. 5, 1976, and which is hereby incorporated by reference.

Another way of creating "in-line" openings is by notching the wellbore on its low side. Notching of wellbores is known to those skilled in the art.

When perforating the wellbore, perforating can be performed by placing the gun in a lubricator which is directed down into the hydrocarbonaceous pay zone through the work string tubing. Use of a lubricator will allow the perforating gun to be removed under pressure when the formation is, as is preferred, allowed to continue production of hydrocarbonaceous fluids. As is preferred, perforating fluids used with the method are selected to provide for an underbalance system within the wellbore to minimize formation damage and to avoid "killing" the well. Once the perforating operation is complete, the perforating gun is then removed from the tubing. If a lubricator has been used, the perforating gun can be removed through the lubricator.

After perforating, a squeeze pack or small fracture treatment is conducted through perforations 22, as shown in the drawing. The area treated 14 is shown in the drawing. This area behind the perforations 22 is treated to preclude fines or other particulate matter from entering the wellbore. Following the squeeze pack or small fracture treatment, any excess sand or other particulate matter is removed from the wellbore. Afterwards, approximately 50 barrels of a fluid compatable with the formation, such as KC1 or NaC1 brine, which is obtainable from various service companies is placed through the tubing. The purpose of this fluid is to condition the formation so as to be receptive to a chemical blocking agent.

Thereafter, a chemical blocking agent is introduced into the formation by said work string tubing. The volume of said chemical blocking agent is determined based upon the extent of the perforated interval and the capacity of the formation area desired to be blocked. Chemical blocking agents suitable for this purpose are available from various service companies. Some of these blocking agents are Temblock blocking agents and Protect-O-Zone, which are obtainable from Halliburton Services and Dowell-Schlumberger, located in Duncan, Ok. and Tulsa, Ok. respectively. If the formation is over-pressured, which means the reservoir pressure is greater than the hydrostatic pressure of water (0.433 psi/ft) standing in the wellbore, the volume of chemical blocking agent should be prepared from a brine solution of greater density than water. The chemical blocking agents can be of a number of related materials including cross-linked fluids or high concentrations of guar or cellulose. These materials will be discussed later. As is anticipated, a relatively small amount, usually less than about 50 barrels, of this fluid is required to isolate the perforated interval and the treated area 14 of the formation. After about 2 to about 4 hours, the chemical blocking agent has reached maximum strength and viscosity or, in the vernacular, set. Subsequently, a high density or weighted brine of about 10 weight percent sodium chloride to about 28 weight percent sodium chloride is injected into said work string tubing on top of the solidified chemical blocking agent. Other high density or weighted solutions which can be used include calcium chloride, potassium chloride, and natural brines. Placement of the high density brine solution on top of the solidified chemical blocking agent allows the first tubing or "work string" to be removed from the well. Upon solidification, the chemical blocking agent also protects the formation 24, as shown in the drawing, and the treated area 14, while forming a solidified plug within the well. After solidification of the chemical blocking agent, the "work string" tubing is removed.

Once said first tubing or "work string" has been removed from the well, a production string 20 having a slotted liner assembly therein is placed into the well and penetrates the solidified chemical blocking agent as is shown in the drawing. The slotted liner portion of production string 20 allows contact to be made through the perforations 22 and into the treated area 14 surrounding the wallbore for placement of a gravel pack. Thereafter, depending upon the composition of the solidified chemical blocking agent, said solidified blocking agent can be removed by either chemical or physical means.

In order to establish a gravel pack 16 as shown in the drawing, it is necessary to remove the solidified chemical blocking agent as discussed above, either by chemical or physical means. Upon removal of the solidified chemical blocking agent from the well, a gravel pack placement operation can begin. Gravel packing methods are known to those skilled in the art. A preferred consolidatable gravel pack method is disclosed by Friedman in U.S. Pat. No. 4,428,427 which issued on Jan. 31, 1984 and which is hereby incorporated by reference. This gravel packing operation immediately follows removal of the solidified chemical blocking agent from the treated area 14 of the formation surrounding the well and also removal of said chemical blocking agent from the core of the well. A preferred method for the removal of the solidified chemical blocking agent from the treated area 14 of the formation, and within the well is to have a gel composition which "breaks" or loses its gel strength within a specified period of time. In this manner, the chemical blocking agent is allowed to flow from the formation 24 into the wellbore. Gel compositions which are suitable for use in this preferred embodiment will be discussed later.

After removing the solidified blocking agent from the washed out portion of said formation and the wellbore, a gravel pack 16 is placed within the well. The gravel pack which is placed into the well around the slotted portion of tubing 20 is sufficient to prevent fines migration from the formation into the well. Placement of said gravel pack constrains the sand within the formation and allows fluid communication between the formation and said wellbore for the production of hydrocarbonaceous fluids.

Chemical blocking agents which are preferred for utilization in the practice of this invention include gellable chemical mixtures. Gellable chemical mixtures which can work in the present invention are selected to withstand conditions encountered in the formation. As will be understood by those skilled in the art, the composition of the mixture can be varied to obtain the desired rigidity in the gel composition. One method of making a suitable, compatible mixture is discussed in U.S. Pat. No. 4,333,461 which issued to Muller on June 8, 1982 and which is hereby incorporated by reference. The stability and rigidity of the selected gel will depend upon the physical and chemical characteristics of the gel which are dictated by conditions in the formation. As is known to those skilled in the art, the "set up" gel should be generally of a stability and rigidity which will withstand the heat and pressures encountered in a formation. Generally, the pressures encountered in a formation will vary from about 500 psig to about 20,000 psig. Heat encountered in a formation will generally vary from about 60° to about 450° F.

Often, it will be necessary to increase the density of the pumpable pre-set gel to obtain the desired stability and rigidity. To accomplish this, a solid non-reactant material can be added to the pumpable gel mixture. Calcium carbonate is a preferred non-reacting solid material.

Other gel mixtures can be used to obtain the desired stability and rigidity. A preferred mixture used to obtain the desired stability and rigidity, for example, is a mixture of hydroxypropyl guar cross-linked with transitional metals and ions thereof. The purpose of the transitional metal ions is to provide increased strength, stability and rigidity to the gel.

Hydroxypropyl guar is placed into the gel mixture in an amount of from about 0.70 to about 10.0 weight percent of said mixture. As is preferred, hydroxypropyl guar is placed in said mixture in about 7.2 percent by weight of said mixture.

Metallic ions which can be used in the pumpable gel mixture include titanium, zirconium, chromium, antimony and aluminum. The concentration of these transitional metals in the pumpable solidifiable gel fluid will of course vary depending upon the requirements for the particular formation being treated. Although the exact amounts of the metals required will vary depending on the particular application, it is anticipated that the metals should be included within the pumpable gel fluid in amounts of from about 0.005 weight percent to about 0.50 weight percent, preferably about 0.01 weight percent of said fluid.

It is often desirable to have a set-up gel which will withstand a formation temperature range from about 300° F. to about 450° F. for from about 0.5 of a day to about 4 days. These solidified gels will be self destructive after about 0.5 of a day to about 4 days. While the gel is solidifying, preparation can be taken for the gravel packing step. A thermally stable gel can be obtained by mixing into the pumpable gel mixture a chemical known as an oxygen scavenger (such as sodium thiosulfate or short chain alcohols such as methanol, ethanol, and isopropanol), preferably sodium thiosulfate. The concentration of the oxygen scavenger utilized, of course, will depend upon the thermal stability desired to be obtained for the solidified gel in the formation. However, as preferred, it is anticipated that the concentration of the oxygen scavenger in the pumpable gel mixture will be from about 0.10 percent by weight to about 0.75 percent by weight, preferably 0.50 percent by weight.

In formations where temperatures are lower, a gel breaker can be placed in the gel mixture prior to injecting the gel into the formation. This gel breaker, included in the gel mixture, is selected from a group of chemicals which can break down the solid gel at temperatures of less than from about 60° F. to about 250° F. Generally this breakdown will occur within from about 2 hours to about 24 hours depending upon type and concentration of breaker added. Chemicals satisfactory for use as gel breakers, and which are incorporated into the gel mixture, include enzymes and oxidizing agents, suitable for breaking down the set-up gel (such as sodium persulfate). Other gel breakers sufficient for this purpose are discussed in U.S. Pat. No. 4,265,311 issued to Ely on May 5, 1981, which is hereby incorporated by reference. These chemicals are readily available from chemical suppliers and with the exception of enzyme breakers are sold under their chemical names. Enzyme breakers can be obtained from oil field service companies. The concentration of the gel breaker incorporated into the gel mixture will vary from about 0.01 weight percent to about 0.10 weight percent, preferably about 0.05 weight percent of the gel mixture. Upon cooling to a temperature of from about 60° F. to about 150° F., the gel breaker will breakdown the solid gel causing it to liquify and flow from the formation.

In one example of the practice of this invention, a slurry is formed with 1,000 gallons of water. This slurry comprises about 40 pounds of base gel such as hydroxypropyl guar gum which forms a gel in the water. To this mixture is added about 600 pounds of chemically treated hydroxypropyl guar gum which has delayed hydration or thickening qualities. Approximately 20 pounds of a buffer or catalyst suitable to obtain the desired pH and reaction time is added to this mixture. A sodium pyrophosphate buffer is suitable for this purpose. Cross-linking agents, such as borates and chromates, are then added in an amount of about 20 pounds. Sodium tetra-borate is suitable for this purpose and preferred. Forty-two pounds of sodium thiosulfate, an oxygen scavenger, is then added to the mixture. This gel mixture is pumped into the well and also into the treated portion 14 of the formation. After gellation of the mixture, any undesired set-up gel in the wellbore can be removed by contacting it with about 7.5 to about 15 volume percent of hydrochloric acid in an amount sufficient to solubilize said gel.

As is understood by those skilled in the art, the composition of a selected gel will depend upon many variables including formation conditions. The above example is mentioned as one possible variation among many others.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

We claim:

1. A method for completion of a well having a deviated wellbore comprising:
(a) cementing a casing string in said wellbore;
(b) running a work string tubing through said casing string;
(c) penetrating through said casing string into a hydrocarbonaceous pay zone via an in-line opening on the low side of said casing thus fluidly communicating said pay zone with said wellbore;
(d) removing any excess particulate matter from said tubing and injecting a chemical blocking agent substantially above said in-line opening which agent upon solidification forms a plug which prevents fluids from entering said wellbore through said opening;
(e) placing a weighted solution on top of said plug in an amount sufficient to allow change-out of said work string tubing with a production tubing and slotted liner;
(f) directing said production tubing and slotted liner through said weighted solution and said plug; and
(g) removing said plug, other solidified blocking agent, and gravel packing the in-casing well area in a manner sufficient to exclude particulate matter from said well when producing hydrocarbonaceous fluids therefrom.

2. The method as recited in claim 1 where in step (c) said in-line opening comprises at least one notch.

3. The method as recited in claim 1 where in step (c) said in-line opening comprises at least two perforations.

4. The method as recited in claim 1 where in step (c) said opening comprises perforations having at least four perforations per foot which perforations are zero degree phased.

5. The method as recited in claim 1 where in step(d) said blocking agent comprises a solidifiable gel mixture which solidifies or sets-up after about 2 to about 4 hours.

6. The method as recited in claim 1 where in step(d) said blocking agent comprises a solidifiable gel mixture which forms a solid sufficient to withstand pressures of from about 500 psig to about 20,000 psig.

7. The method as recited in claim 1 wherein step(d) said blocking agent comprises a solidifiable gel mixture which forms a solid able to withstand temperatures greater than about 450° F.

8. The method as recited in claim 1 where in step(d) said blocking agent comprises a solidifiable gel mixture which becomes solid or sets-up and is made thermally stable for temperatures of from about 350° F. to about 450° F. for from about 0.5 of a day to about 4 days.

9. The méthod as recited in claim 1 where in step(d) said blocking agent comprises a solidifiable gel mixture into which a gel breaker is added in amounts sufficient to breakdown the subsequently formed solid or set-up gel at temperatures of less than from about 60° F. to about 250° F. within from about 2 hours to about 24 hours.

10. The method as recited in claim 1 where in step(d) said blocking agent comprises a solidifiable gel mixture into which an oxygen scavenger is placed in a concentration of about 0.10 about 0.75 weight percent of said mixture, and said oxygen scavenger is a material selected from the group consisting of sodium thiosulfate and a short chain alcohol.

11. The method as recited in claim 1 where in step(d) said blocking agent comprises a solidifiable gel mixture which contains a gel breaker capable of breaking down a subsequently formed solid gel at temperatures less than from about 60° F. to about 250° F. within from about 2 to about 24 hours.

12. The method as recited in claim 1 wherein in step (d) said blocking agent comprises a solidifiable gel mixture which contains a gel breaker capable of breaking down said subsequently formed solid gel where said gel breaker is a material selected from the group consisting of an enzyme and an oxidizing agent.

13. The method as recited in claim 1 where in step(g) the plug and other solidified blocking agent are removed from the wellbore and treated pay zone by hydrochloric acid in a strength of about 7.5 to about 15.0 volume percent.

14. The method as recited in claim 1 where after step(c) the pay zone is treated via said in-line opening with a filtering means to pack the area in the formation behind said in-line opening which means comprises a squeeze pack or small fracture treatment.

15. The method as recited in claim 1 where in step(e) said weighted solution is a member selected from the group consisting of sodium chloride, calcium chloride, potassium chloride, and natural brine in a strength of about 10 to about 28 weight percent in water.

16. A method for well completion in an inclined wellbore in an offshore location which wellbore contains an in-casing gravel pack to control formation fines comprising:
(a) cementing a casing string in said wellbore;
(b) running a work string tubing through said casing string;
(c) penetrating through said tubing into a hydrocarbonaceous pay zone via an in-line opening said tubing on the low side of said casing thus fluidly communicating said pay zone with said wellbore;
(d) removing any excess particulate matter from said tubing and injecting a chemical blocking agent substantially above said in-line opening which agent upon solidification forms a plug which prevents fluids from entering said wellbore through said opening;
(e) placing a weighted solution on top of said plug in an amount sufficient to allow change-out of said work string tubing with a production tubing and slotted liner;
(f) directing said production tubing and slotted liner through said weighted solution and said plug; and
(g) removing said plug, other solidified blocking agent, and gravel packing the in-casing well area in a manner sufficient to exclude particulate matter from said well when producing hydrocarbonaceous fluids therefrom.

17. The method as recited in claim 16 where in step(c) said in-line opening comprises at least one notch.

18. The method as recited in claim 16 in step(c) said in-line opening comprises at least two perforations.

19. The method as recited in claim 16 where in step(c) said opening comprises perforations having at least four perforations per foot which perforations are zero degree phased.

20. The method as recited in claim 16 where in step(d) said blocking agent comprises a solidiiable gel mixture which solidifies after about 2 to about 4 hours.

21. The method as recited in claim 16 where in step(d) said blocking agent comprises a solidifiable gel mixture which forms a solid sufficient to withstand pressures of from about 500 psig to about 20,000 psig.

22. The method as recited in claim 16 where in step(d) said blocking agent comprises a solidifiable gel mixture which forms a solid able to withstand temperatures greater than about 450° F.

23. The method as recited in claim 16 where in step(d) said blocking agent comprises a solidifiable gel mixture which becomes solid and is made thermally stable for temperatures of from about 350° F. to about 450° F. for from about 0.5 of a day to about 4 days.

24. The method as recited in claim 16 where in step(d) said blocking agent comprises a solidifiable gel mixture into which a gel breaker is added in amounts sufficient to breakdown the subsequently formed solid gel at temperatures of less than from about 60° F. to about 250° F. within from about 2 hours to about 24 hours.

25. The method as recited in claim 16 where in step(d) said blocking agent comprises a solidifiable gel mixture into which an oxygen scavenger is placed in a concentration of about 0.10 to about 0.75 weight percent of said mixture, and said oxygen scavenger is a material selected from the group consisting of sodium thiosulfate and a short chain alcohol.

26. The method as recited in claim 16 where in step(d) said blocking agent comprises a solidifiable gel mixture which contains a gel breaker capable of breaking down a subsequently formed solid gel at temperatures less than from about 60° F. to about 250° F. within from about 2 to about 24 hours.

27. The method as recited in claim 16 where in step(d) said blocking agent comprises a solidifiable gel mixture which contains a gel breaker capable of breaking down said subsequently formed solid gel where said gel breaker is a material selected from the group consisting of an enzyme and an oxidizing agent.

28. The method as recited in claim 16 where in step(g) the plug and other solidified blocking agent are removed from the wellbore and treated pay zone by hydrochloric acid in a strength of about 7.5 to about 15.0 volume percent.

29. The method as recited in claim 16 where after step(c) the pay zone is treated via said in-line opening with a filtering means to pack the area in the formation behind said in-line opening which means comprises a squeeze pack or small fracture treatment.

30. The method as recited in claim 16 where in step(e) said weighted solution is a member selected from the group consisting of sodium chloride, calcium chloride, potassium chloride, and natural brine in a strength of about 10 to about 28 weight percent in water.

* * * * *